US005288782A

United States Patent [19]

Nakajima et al.

[11] Patent Number: 5,288,782

[45] Date of Patent: Feb. 22, 1994

[54] ROSIN EMULSION SIZING AGENTS FOR PAPERMAKING

[75] Inventors: Masato Nakajima; Itsuro Sakai; Nobuyuki Tani, all of Osaka, Japan

[73] Assignee: Arakawa Chemical Industries Ltd., Osaka, Japan

[21] Appl. No.: 39,241

[22] PCT Filed: Aug. 28, 1992

[86] PCT No.: PCT/JP92/01107

§ 371 Date: Apr. 26, 1993

§ 102(e) Date: Apr. 26, 1993

[87] PCT Pub. No.: WO93/05231

PCT Pub. Date: Mar. 18, 1993

[30] Foreign Application Priority Data

Sep. 10, 1991 [JP] Japan ..... 258424

[51] Int. Cl.[5] ..... C08L 93/24; C08L 31/02; C08L 39/02; C08L 31/00

[52] U.S. Cl. ..... 524/272; 524/563; 524/564

[58] Field of Search ..... 524/272, 555, 556, 563, 524/564

[56] References Cited

U.S. PATENT DOCUMENTS

| | | | |
|---|---|---|---|
| 4,115,331 | 9/1978 | Tominaga et al. | 524/272 |
| 4,129,711 | 12/1978 | Viout et al. | 524/563 |
| 4,294,873 | 10/1981 | Hartmann et al. | 524/555 |
| 4,943,608 | 7/1990 | Takahashi et al. | 524/272 |

*Primary Examiner*—Paul R. Michl
*Assistant Examiner*—Peter Szekely
*Attorney, Agent, or Firm*—Armstrong, Westerman, Hattori, McLeland & Naughton

[57] ABSTRACT

The sizing agent of the invention contains a rosin substance, a dispersant and water in which an amphoteric, anionic or cationic copolymer is used as the dispersant, the copolymer being prepared by copolymerizing (A) a vinyl carboxylate as an essential monomer and (B) an anionic unsaturated monomer and/or (C) a cationic unsaturated monomer.

8 Claims, No Drawings

ROSIN EMULSION SIZING AGENTS FOR PAPERMAKING

TECHNICAL FIELD

The present invention relates to novel rosin emulsion sizing agents for papermaking and more particularly to rosin emulsion sizing agents for papermaking which are prepared using a specific copolymer as a dispersant.

BACKGROUND ART

In view of the desirability for a closed papermaking system, rosin emulsion sizing agents for papermaking are in predominant use in recent years. Consequently extensive investigations have been made on dispersing agents for use in preparing the rosin emulsion sizing agents. Conventional dispersants include low-molecular-weight dispersants such as sodium alkylsulfonates, sodium alkylbenzenesulfonates, polyoxyethylene alkyl phenyl ethers and sulfuric acid ester salts of polyoxyethylene alkyl phenyl ethers. However, emulsion sizing agents prepared using the low-molecular-weight dispersant markedly bubble up when used for papermaking and fail to produce a satisfactory sizing effect when used for papermaking at high temperatures or high pH values. Rosin emulsion sizing agents have been developed in which a polymer dispersant is used to obviate the drawbacks of the low-molecular-weight dispersants. These sizing agents are substantially free of bubbling in papermaking, but still unsatisfactory in sizing effect when used for papermaking at high temperatures or high pH values.

DISCLOSURE OF THE INVENTION

It is an object of the present invention to provide a novel rosin emulsion sizing agent which is usable for papermaking free of the foregoing prior art drawbacks.

It is another object of the invention to provide a papermaking rosin emulsion sizing agent which is effectively usable over a wide pH range, serviceable without decrease of sizing degree even when used in papermaking at high temperatures, less susceptible to bubbling and easy to handle in use.

These and other objects of the invention will become more apparent from the following description.

According to the present invention, there are provided:

(1) a rosin emulsion sizing agent for papermaking, comprising a rosin substance, a dispersant and water, the sizing agent being characterized in that the dispersant is a copolymer comprising (A) 20 to 90% by weight of a vinyl carboxylate, (B) 1 to 60% by weight of an anionic unsaturated monomer and (C) 1 to 60% by weight of a cationic unsaturated monomer; and (2) a rosin emulsion sizing agent for papermaking, comprising a rosin substance, a dispersant and water, the sizing agent being characterized in that the dispersant is a copolymer comprising (A) 20 to 90% by weight of a vinyl carboxylate, and (B) 10 to 80% by weight of an anionic unsaturated monomer or (C) 10 to 80% by weight of a cationic unsaturated monomer.

To overcome the foregoing prior art drawbacks, the present inventors conducted extensive research with attention directed to dispersants for use in dispersing a rosin substance in the preparation of a rosin emulsion sizing agent for papermaking. As a result, their research revealed the following. When a rosin substance is dispersed in water in the presence of said dispersant, namely the above-specified copolymer containing a vinyl carboxylate as an essential monomer, the papermaking rosin emulsion sizing agent obtained is less susceptible to bubbling or foaming, is suitably usable even in papermaking over a wide pH range and is serviceable without decrease of sizing degree even in papermaking at high temperatures. The present invention has been accomplished based on this novel finding.

The rosin substance to be dispersed in the present invention is one comprising 0 to about 95% by weight of a rosin, and about 5 to about 100% by weight of a rosin derivative, optionally together with up to 50% by weight of an extender.

Examples of useful rosins are gum rosin, wood rosin, tall oil rosin and the like. These rosins can be used singly or at least two of them are usable in mixture. Examples of useful rosin derivatives are hydrogenated rosins, disproportionated rosins, polymerized rosins, aldehyde-modified rosins and like modified rosins, fortified rosins, rosin esters and fortified rosin esters. Extenders which can be optionally incorporated into the rosin substance include, for example, paraffin wax, microcrystalline wax and like waxes, petroleum resins, terpene resins, these resins as hydrogenated and like hydrocarbon resins.

Among these rosin derivatives, an aldehyde-modified rosin is usually obtainable, for example, by reacting a rosin with formaldehyde or acetaldehyde in an amount of about 2 to about 8% by weight based on the rosin in the presence of an acid catalyst such as sulfuric acid, paratoluenesulfonic acid or the like at a temperature of about 140° to about 200° C. for about 0.5 to about 3 hours.

A fortified rosin can be prepared by reacting a rosin and/or a modified rosin with about 2 to about 30% by weight, preferably about 3 to about 20% by weight, of $\alpha,\beta$-unsaturated carboxylic acid at an elevated temperature of about 150° to about 250° C. Usable as the $\alpha,\beta$-unsaturated carboxylic acid are acrylic acid, methacrylic acid, maleic acid, fumaric acid, itaconic acid, citraconic acid, anhydrides thereof and mixtures thereof. Among them, fumaric acid, maleic acid and maleic anhydride are preferred.

Rosin esters which can be used are not limited specifically, and are suitably selected from conventional rosin esters. Fortified rosin esters can be prepared by successively or simultaneously reacting a rosin and/or a modified-rosin with a conventional alcohol and $\alpha,\beta$-unsaturated carboxylic acid.

The copolymer for use as a dispersant in the present invention is an amphoteric copolymer, an anionic copolymer or a cationic copolymer which is each prepared by copolymerizing (A) a vinyl carboxylate as the essential monomer with (B) an anionic unsaturated monomer and/or (C) a cationic unsaturated monomer.

The vinyl carboxylate (A) useful as the essential monomer for the copolymer is not limited specifically, and includes a wide variety of known vinyl carboxylates. Examples of useful vinyl carboxylates are vinyl acetate, vinyl propionate, vinyl n-butyrate, vinyl iso-butyrate, vinyl n-valerate, vinyl iso-valerate, vinyl pivalate, vinyl monochloroacetate, vinyl benzoate, vinyl caproate, vinyl caprate, vinyl 2-ethylhexanoate, vinyl laurate, vinyl myristate, vinyl palmitate and vinyl stearate. At least one of these monomers is used. The monomer (A) increases the dispersibility of the rosin substance, improves the dispersion stability of the obtained aqueous emulsion and reduces the susceptibility thereof to bubbling or foaming.

The anionic unsaturated monomer (B) is used to impart anionic properties to the obtained copolymer and can pronouncedly improve the dispersion stability of the obtained aqueous emulsion and the sizing effect thereof. Useful anionic unsaturated monomers include, for example, acrylic acid, methacrylic acid, itaconic acid, maleic anhydride and like ethylenically unsaturated carboxylic acids and ammonium salts or alkali metal salts thereof. Optionally the anion group in the anionic unsaturated monomer is neutralized with alkali such as ammonia, lower amine, alkali metal hydroxide or the like after the copolymerization to give an ammonium salt or an alkali metal salt.

The cationic unsaturated monomer (C) is used to impart cationic properties to the obtained copolymer and can increase the ability of the obtained emulsion sizing agent to fix to pulps. Especially the monomer (C) could produce pronounced effects in these respects if aluminum sulfate is used in a small amount or if the sizing agent is used at a high pH value. Examples of the cationic unsaturated monomer (C) are N,N-dialkylamino(hydroxy)alkyl (meth)acrylate, N,N-dialkylamino(hydroxy)alkyl (meth)acrylamide, mineral acid salts of these monomers, these monomers as quaternized, allylamine, diallylamine, diallylmonomethylamine and dimethyldiallylammonium chloride. Preferred among them are, for example, N,N-dimethylaminomethyl (meth)acrylate, N,N-dimethylaminoethyl (meth)acrylate, N,N-diethylaminomethyl (meth)acrylate, N,N-diethylaminoethyl (meth)acrylate, N,N-dimethylaminopropyl (meth)acrylate, N,N-diethylaminopropyl (meth)acrylate, N,N-dimethylaminomethyl (meth)acrylamide, N,N-dimethylaminoethyl (meth)acrylamide, N,N-diethylaminomethyl (meth)acrylamide, N,N-diethylaminoethyl (meth)acrylamide, N,N-dimethylaminopropyl (meth)acrylamide, N,N-diethylaminopropyl (meth)acrylamide, 3-diethylamino-2-hydroxypropyl (meth)acrylate, 3-(N,,N,-dimethylamino-N-methylamino)-2-hydroxypropyl (meth)acrylate, 3-dimethylamino-2-hydroxypropyl (meth)acrylamide, 3-diethylamino-2-hydroxypropyl (meth)acrylamide, 3-allyloxy-2-hydroxypropyldimethylamine, vinyl benzyldimethylamine, 4-(vinylbenzyl)morpholine, mineral acid salts of these compounds and these compounds as quaternized. Mineral acids suitable for the preparation of mineral acid salts are hydrochloric acid, sulfuric acid and the like. The quaternizing agent for quaternization is not limited specifically, and various known compounds are usable. Preferable examples of such agents are epihalohydrin, methyl halides, benzyl halides, methylsulfuric acid and the like. While the quaternization reaction can be conducted for the monomer, the obtained copolymer can also be subjected to this reaction.

The copolymer to be used as the dispersant in the present invention can be easily prepared by copolymerizing the above monomers by various known processes. The amount of the monomers constituting the dispersant for use herein can be suitably determined in view of the stability of the obtained aqueous emulsion, susceptibility to bubbling or foaming, sizing effect and the like.

For the preparation of an amphoteric copolymer dispersant, the proportions of the monomers used are (A) 20 to 90% by weight, preferably 40 to 80% by weight, of the vinyl carboxylate, (B) 1 to 60% by weight, preferably 5 to 55% by weight, of the anionic unsaturated monomer and (C) 1 to 60% by weight, preferably 5 to 55% by weight, of the cationic unsaturated monomer. For the preparation of an anionic copolymer dispersant, the proportions of the monomers used are (A) 20 to 90% by weight, preferably 40 to 80% by weight, of the vinyl carboxylate and (B) 10 to 80% by weight, preferably 20 to 60% by weight, of the anionic unsaturated monomer. For the preparation of a cationic copolymer dispersant, the proportions of the monomers used are (A) 20 to 90% by weight, preferably 40 to 80% by weight, of the vinyl carboxyiate, and (C) 10 to 80% by weight, preferably 20 to 60% by weight, of the cationic unsaturated monomer.

In addition to the monomers (A), (B) and (C), another nonionic unsaturated monomer (D) than the monomer (A) may be used. The amount of the other nonionic unsaturated monomer (D) used is up to 20% by weight. Examples of monomers useful as the nonionic unsaturated monomer (D) are (meth)acrylamide, (meth)acrylonitrile, α-olefin having 6 to 22 carbon atoms, alkyl vinyl ether having 1 to 22 carbon atoms, alkyl (meth)acrylate having 1 to 22 carbon atoms, styrene and vinyl pyrrolidone.

If the amounts of the unsaturated monomers used for the copolymer are below the above ranges, the obtained copolymer tends to exhibit reduced dispersing properties. If the amounts of the unsaturated monomers (B) and (C) are below the lower limits of said ranges, the resulting emulsion sizing agent is undesirably reduced in its ability to fix to pulps.

The foregoing copolymers can be prepared by conventional methods, such as solution polymerization, emulsion polymerization or suspension polymerization. When solution polymerization is resorted to, solvents such as isopropyl alcohol and methyl isobutyl ketone are usable. An emulsifying agent to be used in emulsion polymerization is not limited specifically, but various surfactants are usable. Examples of useful anionic surfactants are dialkylsulfosuccinic acid ester salt, alkanesulfonic acid salts, α-olefinsulfonic acid salt, polyoxyethylene alkyl ether sulfosuccinic acid ester salt, polyoxyethylene styryl phenyl ether sulfosuccinic acid ester salt, naphthalinsulfonic acid formalin condensate, polyoxyethylene alkyl ether sulfuric acid ester salt and polyoxyethylene alkyl phenyl ether sulfuric acid ester salt. Examples of useful nonioninc surfactants are polyoxyethylene alkyl ether, polyoxyethylene styryl phenyl ether and poloxyethylene sorbitan fatty acid ester. Also usable as said anionic or nonionic surfactants are reactive ones having a vinyl group or allyl group introduced therein. One or at least two of these surfactants are suitably selected for use. The amount of the surfactant used is about 0.1 to about 10% by weight based on the combined amount of the monomers charged into the reactor.

The polymerization initiator to be used in the polymerization is not limited specifically, and various initiators such as persulfuric acid salts, peroxides, azo compounds and redox initiators can be used.

As to the molecular weight of the cooolymer to be used in the invention, the copolymer is preferably 1,000 to 200,000 in weight average molecular weight in view of proper dispersing of the rosin substance. The molecular weight of the copolymer is adjustable to said range using a suitable known chain transfer such as isopropyl alcohol, carbon tetrachloride, ethylbenzene, isopropylbenzene, cumene, thioglycollic acid ester, alkylmercaptan or 2,4-diphenyl-4-methyl-1-pentene. The amount of the chain transfer agent used is about 0.5 to about 30% by weight based on the combined amount of the monomers charged into the reactor. The copolymer is dispersible in water although usually soluble in water.

The sizing agent of the present invention can be prepared using the thus obtained copolymer by any of conventional methods disclosed for example in Japanese Examined Patent Publication No. 4866/1978 (melting high pressure emulsifying method), Japanese Examined Patent Publication No.22090/1978 (solvent high pressure emulsifying method), Japanese Unexamined Patent Publication No.77206/1977 and Japanese Examined Patent Publication No.4938/1983 (reversal emulsifying method).

For example, when the solvent high pressure emulsifying method is used, the sizing agent is prepared by adding the copolymer as the dispersant, water and optionally sodium hydroxide, potassium hydroxide, ammonia, lower amine or like alkalis to the rosin substance as dissolved in a water-insoluble organic solvent, emulsifying the mixture by a homogenizer, piston type high pressure emulsifier, ultrasonic emulsifier or the like and distilling off the organic solvent. When to add the copolymer is not limited specifically. The copolymer may be added to an emulsion as delivered from the emulsifier or after the removal of the solvent. In either case, a satisfactory aqueous emulsion can be obtained.

When the reversal emulsifying method is used, the sizing agent is prepared, for example, in the following manner. The rosin substance is heated usually to 90° to 160° C. with stirring to obtain a melt, and an aqueous solution of the copolymer and a specified amount of hot water are added to the melt with stirring to undergo phase reversal, giving an emulsion in which the rosin substance is a dispersed phase and the water is a continuous phase.

In the solvent high pressure emulsifying method or reversal emulsifying method, the copolymer dispersant is used in an amount of 1 to 30% by weight, preferably 2 to 20% by weight, based on the rosin substance as calculated on a dry weight basis. If less than 1% by weight of the copolymer is used, unsatisfactory dispersibility results, whereas more than 30% by weight used is not economical. When required, the emulsion obtained as desired can be diluted with water or alkali water and thereby adjusted in pH.

In the solvent high pressure emulsifying method or reversal emulsifying method, a surfactant may be added to the copolymer in an amount that will not adversely affect the reduced susceptibility to bubbling and the sizing effect of the sizing agent. Useful surfactants include those usable in preparing the copolymer by emulsion polymerization.

The thus obtained rosin emulsion sizing agent contains 10 to 70% by weight, preferably 30 to 60% by weight, of solids. The emulsion has the rosin substance uniformly dispersed therein in the form of particles up to 1 μm, mostly up to 0.5 μm, in size. The aqueous emulsion appears milky white and has a pH of 2.0 to 6.5.

The aqueous emulsion of the invention remains stable for at least 6 months at room temperature free of precipitation. Because of its high dilution stability, the agent can be satisfactorily diluted with water of rivers, wells and the like or tap water. In this case, the diluted agent is effectively dispersed in an aqueous dispersion of pulps. Furthermore, the diluted agent exhibits good stability for a prolonged period of time. In addition, the agent has good mechanical stability and is greatly reduced in susceptibility to bubbling, as described in Examples later.

The emulsion sizing agent of the invention can be admixed for example with an aqueous dispersion of pulp together with a fixing agent such as aluminum sulfate or a cationic one in papermaking at a pH of 4 to 8 with the result that a high sizing effect can be produced over a wide pH range. In this case, the sizing agent is used in an amount of about 0.05 to about 3% by weight (dry weight) based on the pulp. The sizing agent of the invention can be effectively fixed to pulps so that the amount of aluminum sulfate is reduced. The sizing agent of the invention is usable without decrease of sizing effect even in papermaking at a high temperature, in papermaking using water of high hardness or in a closed papermaking system utilizing wastepaper or the like which results in increased impurities.

The papermaking emulsion sizing agent of the invention is advantageously usable not only for making paper from cellulose fibers but also for making paper, paperboards, fiberboards and the like from a mixture of cellulose fibers and mineral fibers such as asbestos or rock wool or synthetic fibers, for example, of polyamide, polyester, polyolefin or the like.

The papermaking emulsion sizing agent of the invention is usable also as a surface sizing agent. In this case, the agent is applied to wet paper by a conventional method such as spraying, dipping or coating.

The following remarkable advantages can be provided according to the present invention.

The papermaking emulsion sizing agent of the invention has good mechanical stability, is reduced in susceptibility to bubbling or foaming and thus ensures an improved papermaking operation. The agent of the invention produces a satisfactory sizing effect when used in papermaking at high temperatures or high pH values and is therefore satisfactorily usable in the closed papermaking system employed in recent years. The agent can be used, of course, as a surface sizing agent.

BEST MODE OF CARRYING OUT THE INVENTION

The present invention will be described below in greater detail with reference to the following reference examples, examples and comparative examples. The reference examples illustrate the preparation of rosin substances and the preparation of copolymer dispersants to be used in the invention. The parts and the percentages in the examples are all by weight.

REFERENCE EXAMPLE 1

Tall oil rosin (1,800 parts) was heated to obtain a melt. A 2.7-part quantity of p-toluenesulfonic acid monohydrate as a catalyst was added to the melt with stirring at a temperature of 165° C. To the mixture was added 118 parts of a 37% aqueous solution of formaldehyde at 160° to 170° C. over a period of 90 minutes. The mixture was stirred at the same temperature for 1 hour, giving a formaldehyde-modified rosin. To the modified rosin was added 1,200 parts of gum rosin, and the mixture was stirred at 175° C. for 1 hour. A 2,950 part-portion of the resulting mixture and 177 parts of fumaric acid were heated to give a melt. The melt was then reacted for 3 hours at 200° C., giving a rosin substance (1) which had an acid value of 203 and a softening point of 103.5.C (ring and ball method, same hereinafter).

REFERENCE EXAMPLE 2

Gum rosin (I000 parts) and 190 parts of fumaric acid were heated to 200.C to give a melt. The melt was then reacted for 4 hours at the same temperature, giving a fortified rosin which was 286 in acid value and 138.5° C. in softening point. A 550-part portion of the obtained fortified rosin and 500 parts of gum rosin were heated to 170° C. and stirred for 30 minutes, giving a rosin substance (2).

REFERENCE EXAMPLE 3

Gum rosin (100 parts) and 4 parts of glycerin [charge equivalent ratio (—OH/—COOH)=0.43]were heated to 250° C. in a nitrogen stream to undergo esterification reaction for 8 hours, giving a reaction product which was 91 in acid value and 81° C. in softening point. The reaction product was cooled to 160° C. and 9 parts of maleic anhydride was added. The mixture was heated to 210° C. and maintained at the same temperature for 2 hours, giving a rosin substance (3) which was 183 in acid value and 102° C. in softening point.

REFERENCE EXAMPLES 4 to 9

The unsaturated monomers as listed below in Table 1 in the combined amount of 100 parts was admixed with 5 parts of lauryl mercaptan, 5 parts of sodium salt of polyoxyethylene (n=I3) dodecyl phenyl ether sulfuric acid ester, 2 parts of polyoxyethylene (n=9) oleyl ether, 3 parts of potassium persulfate and 400 parts of water. The mixture was heated for 6 hours of reaction at 80° C. The resulting reaction mixture was cooled to 60° C. and ammonia was added in an equimolecular amount relative to the anionic unsaturated monomer. The mixture was stirred for 1 hour, giving an aqueous solution (or emulsion) containing 15% of a saponification product of the copolymer.

TABLE 1

| Ref. Ex. | Vinyl carboxylate | Anionic unsaturated monomer |
|---|---|---|
| 4 | Vinyl pivalate (60%) | Methacrylic acid (40%) |
| 5 | Vinyl acetate (50%) | Acrylic acid (50%) |
| 6 | Vinyl laurate (70%) | Methacrylic acid (30%) |
| 7 | Vinyl monochloroacetate (60%) | Acrylic acid (40%) |
| 8 | Vinyl benzoate (60%) | Methacrylic acid (40%) |
| 9 | Vinyl 2-ethylhexanoate (80%) | Acrylic acid (20%) |

REFERENCE EXAMPLE 10

Placed dropwise into the reactor were 100 parts of methyl isobutyl ketone, 60 parts of vinyl pivalate, 40 parts of methacrylic acid and 3 parts of azobisisobutyronitrile at 115° C. over 2 hours to undergo polymerization. The reaction mixture was maintained at the same temperature for 4 hours to complete the polymerization. The obtained reaction product containing a copolymer was cooled to 60° C. Potassium hydroxide in an equimolecular amount relative to the anionic unsaturated monomer was dissolved in 100 parts of water. The solution was added to the reaction product in order for the copolymer to undergo saponification. After the saponification, the methyl isobutyl ketone was removed by steam distillation, giving an aqueous solution containing 15% of a saponification product of the copolymer.

REFERENCE EXAMPLE 11

The reactor was charged with 60 parts of vinyl pivalate, 40 parts of N,N-dimethylaminopropyl acrylamide, 5 parts of lauryl mercaptan, 5 parts of sodium salt of polyoxyethylene (n=13) dodecyl phenyl ether sulfuric acid ester, 2 parts of polyoxyethylene (n=9) oleyl ether, 3 parts of potassium persulfate and 400 parts of water. The mixture was heated to 80° C. for 6-hour reaction. The reaction mixture thus obtained was cooled, giving an emulsion containing 15% of the copolymer.

REFERENCE EXAMPLE 12

A reaction was carried out in the same manner as in Reference Example 4 with the exception of using 60 parts of vinyl pivalate, 20 parts of methacrylic acid, and 20 parts of N,N-dimethylaminopropyl acrylamide as quaternized with methyl chloride, giving an emulsion containing 15% of the copolymer.

EXAMPLES 1 to 10

The rosin substance (100 parts) shown below in Table 2 was dissolved in 100 parts of benzene. Added to the solution was 200 parts of an aqueous solution prepared by diluting with soft water the predetermined amount of each vinyl carboxylate copolymer obtained in Reference Examples of 4 to 12. The mixture was heated to 40° C. and pre-emulsified by a homogenizer (5,000 r.p.m., 1 minute). The obtained pre-emulsion was passed twice at the same temperature through a piston type high pressure emulsifier (adjusted to a shearing force of 300 kg/cm$^2$) for emulsification. The benzene was removed from the obtained emulsion by distillation at 40.C under reduced pressure, giving an aqueous emulsion as the sizing agent of the present invention. Table 2 below shows the rosin substances and copolymers in the listed amounts (part, dry weight basis) used for preparation of each emulsion.

TABLE 2

| Ex. | Rosin substance | Kind of copolymer | Amount |
|---|---|---|---|
| 1 | (1) | Copolymer of Ref. Ex. 4 | 10 |
| 2 | (1) | Copolymer of Ref. Ex. 4 | 20 |
| 3 | (1) | Copolymer of Ref. Ex. 5 | 10 |
| 4 | (2) | Copolymer of Ref. Ex. 6 | 5 |
| 5 | (2) | Copolymer of Ref. Ex. 7 | 10 |
| 6 | (2) | Copolymer of Ref. Ex. 8 | 10 |
| 7 | (3) | Copolymer of Ref. Ex. 9 | 10 |
| 8 | (3) | Copolymer of Ref. Ex. 10 | 10 |
| 9 | (3) | Copolymer of Ref. Ex. 11 | 10 |
| 10 | (3) | Copolymer of Ref. Ex. 12 | 10 |

EXAMPLE 11

A 100-part portion of the rosin substance (1) obtained in Reference Example 1 and 10 parts (solids basis) of the copolymer obtained in Reference Example 4 were diluted with soft water to give 200 parts of an aqueous solution. The solution was charged into an autoclave to which the piston type high pressure emulsifier as described in Example 1 was connected. The solution in the autoclave was heated to 180° C. and stirred at the same temperature for 1 hour to undergo preemulsification. The obtained pre-emulsion was passed through the aforesaid emulsifier adjusted to a shearing force of 300 kg/cm$^2$. The obtained aqueous emulsion was cooled by a water-cooling condenser, giving an aqueous emulsion as the sizing agent of the present invention.

EXAMPLE 12

One hundred parts of the rosin substance (1) obtained in Reference Example 1 was dissolved in 100 parts of benzene. To the solution was added 200 parts of an aqueous solution prepared by diluting with soft water one part (calculated as solids) of sodium salt of polyoxyethylene (n=13) distyryl phenyl ether sulfuric acid ester. The mixture was emulsified in the same manner as in Example 1 and then the benzene was distilled off. To the obtained emulsion was added the aqueous solution of the copolymer prepared in Reference Example 4 to make a mixture containing 10 parts of copolymer solids. The mixture was stirred at 60° C. for 1 hour, giving an aqueous emulsion as the sizing agent of the invention.

EXAMPLE 13

A flask equipped with a stirrer and a thermometer was charged with 100 parts of the rosin substance (1) obtained in Reference Example 1. The rosin substance was heated to 150° C. to give a melt. Forty parts of the aqueous solution of 15% copolymer obtained in Reference Example 4 was added to the molten rosin substance over a period of 2 to 3 minutes. At this point, a substantial portion of water was evaporated off and the temperature was decreased to 93° C. Twenty parts of hot water (95° C.) was added, giving a water-in-oil type creamy emulsion. Seventy parts of hot water (90° C.) was added with vigorous stirring to the emulsion over 1 minute to undergo phase reversal, giving an oil-in-water type emulsion. The obtained emulsion was rapidly cooled from outside to 30° C., giving an aqueous emulsion as the sizing agent of the invention.

COMPARATIVE EXAMPLE 1

The reactor was charged with 50 parts of styrene, 10 parts of methyl methacrylate, 40 parts of methacrylic acid, 5 parts of dodecylmercaptan, 4 parts (solids basis) of sodium salt of polyoxyethylene (n=12) nonylphenyl ether sulfuric acid ester, 1 part of polyoxyethylene (n=10) dodecyl phenyl ether, 2 parts of potassium persulfate and 400 parts of water. The mixture was stirred and heated to 80° C. for 4 hours. Thereafter the mixture was cooled to 60° C., followed by the addition of potassium hydroxide in an equimolecular amount relative to the methacrylic acid. The mixture was stirred for 1 hour, giving a 20% aqueous solution of the copolymer. Emulsification was conducted in the same manner as in Example 1 using the copolymer thus obtained, giving a comparative aqueous emulsion.

COMPARATIVE EXAMPLE 2

Water (850 parts) was added to 8 parts of isopropyl alcohol and 12 parts of 36% hydrochloric acid. The obtained solution was heated to 65° C. A solution of 110 parts of acrylamide and 7 parts of acrylic acid in 75 parts of water, 53 parts of dimethylaminoethyl methacrylate and ammonium peroxosulfate were added dropwise thereto with stirring over a period of about 3 hours. The mixture was reacted for a further 2 hours, and cooled, giving a 15% aqueous solution of the copolymer. Emulsification was carried out in the same manner as in Example 1 using the copolymer thus obtained, giving a comparative aqueous emulsion.

COMPARATIVE EXAMPLE 3

A reaction was performed in the same manner as in Comparative Example 1 with the exception of using 50 parts of ethyl acrylate, 10 parts of methyl methacrylate and 40 parts of acrylic acid in place of the unsaturated monomers, giving a 20% aqueous solution of the copolymer. Emulsification was conducted in the same manner as in Example 1 using the copolymer thus obtained, giving a comparative aqueous emulsion.

COMPARATIVE EXAMPLE 4

One hundred parts of methyl isobutyl ketone, 40 parts of styrene, 30 parts of methyl methacrylate, 30 parts of N,N-dimethylaminopropyl acrylamide as quaternized with methyl chloride and 12 parts of azobisisobutyronitrile were placed dropwise into the reactor at 115° C. over 2 hours to undergo polymerization. Then the reaction mixture was maintained at the same temperature for 4 hours to complete the polymerization. The methyl isobutyl ketone was removed by steam distillation. Acetic acid was added in an equimolecular amount relative to the N,N-dimethlaminopropyl acrylamide, giving a 15% aqueous solution of the copolymer. Twenty parts of the obtained copolymer was added to 100 parts of the rosin substance (1) prepared in Reference Example 1 to undergo phase reversal, whereby a comparative aqueous emulsion was prepared.

COMPARATIVE EXAMPLE 5

An aqueous solution of the copolymer was prepared in the same manner as in Comparative Example 1 with the exception of using 50 parts of styrene, 10 parts of vinyl pivalate and 40 parts of acrylic acid in place of the unsaturated monomers. Emulsification was carried out in the same manner as in Example 1 using the obtained copolymer, giving a comparative aqueous emulsion.

The emulsions prepared in Examples 1 to 13 and Comparative Examples 1 to 5 were tested for mechanical stability and susceptibility to bubbling by the following methods.

(1) Mechanical stability

Fifty grams of each aqueous emulsion sample weighed out was placed into the container of a Malon type stability tester (product of Shinboshi Sangyo Co., Ltd.) and subjected to mechanical shear under a load of 10 kg at a rotational speed of 1,000 r.p.m. at 25° C. for 5 minutes. The coagulum thus obtained was separated by filtration with a 100-mesh metal gauze. The mechanical stability was calculated by the following equation.

$$\text{Mechanical stability (\%)} = (\text{dry weight of coagulum/dry weight of emulsion sample}) \times 100$$

(2) Susceptibility to bubbling (A)

Each aqueous emulsion sample was diluted with deionized water to a concentration of 5% and the diluted emulsion was evaluated in the height (mm) of bubbles according to JIS K 3362.

(3) Susceptibility to bubbling (B)

To a 1% aqueous slurry of a pulp (L-BKP) were added each aqueous emulsion in an amount of 5% based on the pulp and aluminum sulfate in an amount of 2.5% based on the pulp (dry weight basis). The obtained aqueous liquid (1 liter) was charged into the apparatus (as specified in JIS K 3362) in which the contents were circulated (8 liters/min) by a pump for 10 minutes and then the circulation was discontinued to measure the height (mm) of bubbles.

Table 3 below shows the characteristics of each emulsion and the test results.

TABLE 3

| | Characteristics | | | Mechanical stability | Susceptibility to bubbling (mm) | |
|---|---|---|---|---|---|---|
| | Concentration | pH | Particle size (μm) | (%) | (A) | (B) |
| Ex. 1 | 33.2 | 4.8 | 1> | 0.1 | 59 | 5 |
| Ex. 2 | 34.5 | 5.0 | 1> | 0.1 | 58 | 6 |
| Ex. 3 | 36.1 | 5.0 | 1> | 0.1 | 61 | 4 |
| Ex. 4 | 30.8 | 4.7 | 1> | 0.1 | 60 | 5 |
| Ex. 5 | 31.6 | 4.8 | 1> | 0.1 | 59 | 5 |
| Ex. 6 | 31.4 | 5.5 | 1> | 0.1 | 61 | 6 |
| Ex. 7 | 33.3 | 4.9 | 1> | 0.1 | 65 | 6 |
| Ex. 8 | 35.1 | 4.7 | 1> | 0.1 | 60 | 5 |
| Ex. 9 | 36.6 | 4.7 | 1> | 0.1 | 59 | 4 |
| Ex. 10 | 35.9 | 5.1 | 1> | 0.1 | 61 | 6 |
| Ex. 11 | 34.0 | 5.2 | 1> | 0.1 | 68 | 6 |
| Ex. 12 | 33.7 | 5.1 | 1> | 0.1 | 66 | 5 |
| Ex. 13 | 50.2 | 5.8 | 1> | 0.1 | 60 | 6 |
| Comp. Ex. 1 | 35.5 | 4.8 | 1> | 0.2 | 135 | 35 |
| Comp. Ex. 2 | 34.1 | 4.6 | 1> | 0.3 | 148 | 49 |
| Comp. Ex. 3 | 33.9 | 5.2 | 1> | 0.1 | 75 | 8 |
| Comp. Ex. 4 | 50.1 | 5.6 | 1> | 0.3 | 138 | 39 |
| Comp. Ex. 5 | 32.6 | 4.2 | 1> | 0.2 | 129 | 30 |

The results of Table 3 revealed the following. When an anionic copolymer, cationic copolymer or amphoteric copolymer each composed of a vinyl carboxylate as the main component is used as a dispersant, an aqueous emulsion can be obtained which has a higher mechanical stability and a markedly lower susceptibility to bubbling than when conventional dispersants are used.

Each of aqueous emulsions obtained in Examples 1 to 13 and in Comparative Examples 1 to 5 was used as a sizing agent in papermaking according to practical Tests 1 and 2 below. The sizing degree (sec) of the papers obtained was evaluated by the Stöckigt method (JIS P8122).

Practical Test 1

Pulps (L-BKP/N-BKP=2/1) were subjected to a beating operation to a Canadian standard freeness of 400 ml and made into a 2% aqueous slurry. A 500-g portion of the pulp slurry maintained at 40° C. was weighed out. To the slurry were added aluminum sulfate in an amount of 1.5% based on the pulps (dry weight basis) and each aqueous emulsion in an amount of 0.2% or 0.5% based on the pulps (dry weight basis) in this sequence which were then uniformly dispersed in the slurry. The slurry thus obtained was made into paper weighing 60±1 g/m$^2$ with use of TAPPI standard sheet machine. The pH of the slurry was 5. The wet paper was dewatered under compression of 5 kg/cm$^2$ for 5 minutes and dried at 100° C. for 1 minute by a drum dryer. Then the obtained paper was stabilized at a relative humidity of 65% and 20° C. for 24 hours and thereafter checked for sizing effect. Table 4 below shows the results.

Practical Test 2

Pulp (newspaper containing 3% calcium carbonate) beaten to a Canadian standard freeness of 300 ml was made into a 2% aqueous slurry. The slurry was then maintained at 50° C. To the slurry were added aluminum sulfate in an amount of 1.0% based on the pulp (dry weight basis), and each aqueous emulsion in an amount of 0.3% based on the pulp (dry weight basis) in this sequence. Subsequently the slurry was diluted to 1% with dilute water having a pH of 6.5 and then stirred for uniform dispersing. The slurry thus obtained was made into paper and checked for sizing effect in the same manner as in Practical Test 1. The slurry used had a pH of 5. Table 4 shows the results.

TABLE 4

| Amount of emulsion | Practical Test 1 | | Practical Test 2 |
|---|---|---|---|
| | 0.2% | 0.5% | 0.3% |
| Ex. 1 | 29.8 | 36.8 | 28.5 |
| Ex. 2 | 29.6 | 38.5 | 29.0 |
| Ex. 3 | 28.9 | 38.8 | 27.0 |
| Ex. 4 | 28.9 | 35.1 | 26.8 |
| Ex. 5 | 28.4 | 37.6 | 27.4 |
| Ex. 6 | 27.6 | 36.9 | 26.1 |
| Ex. 7 | 27.7 | 34.0 | 30.8 |
| Ex. 8 | 25.9 | 34.8 | 33.6 |
| Ex. 9 | 29.4 | 31.9 | 38.4 |
| Ex. 10 | 26.1 | 36.7 | 35.1 |
| Ex. 11 | 27.1 | 37.3 | 26.2 |
| Ex. 12 | 28.1 | 34.1 | 27.0 |
| Ex. 13 | 28.6 | 36.8 | 26.9 |
| Comp. Ex. 1 | 16.4 | 27.6 | 10.6 |
| Comp. Ex. 2 | 15.9 | 26.9 | 11.2 |
| Comp. Ex. 3 | 20.3 | 30.0 | 15.6 |
| Comp. Ex. 4 | 16.5 | 25.4 | 11.7 |
| Comp. Ex. 5 | 15.9 | 25.8 | 10.9 |

We claim:

1. A rosin emulsion sizing agent for papermaking, comprising a rosin substance, a dispersant and water, the sizing agent being characterized in that the dispersant is a copolymer comprising (A) 20 to 90% by weight of a vinyl carboxylate, (B) 1 to 60% by weight of an anionic unsaturated monomer and (C) 1 to 60% by weight of a cationic unsaturated monomer.

2. A rosin emulsion sizing agent according to claim 1 which contains (D) up to 20% by weight of another nonionic unsaturated monomer than the monomer (A).

3. A rosin emulsion sizing agent according to claim 1 wherein the dispersant has a weight average molecular weight of 1,000 to 200,000.

4. A rosin emulsion sizing agent according to claim 1 wherein the content of the dispersant is 1 to 30% by weight based on the rosin substance as calculated on dry weight basis.

5. A rosin emulsion sizing agent for papermaking, comprising a rosin substance, a dispersant and water, the sizing agent being characterized in that the dispersant is a copolymer comprising (A) 20 to 90% by weight of a vinyl carboxylate, and (B) 10 to 80% by weight of an anionic unsaturated monomer or (C) 10 to 80% by weight of a cationic unsaturated monomer.

6. A rosin emulsion sizing agent according to claim 5 which contains (D) up to 20% by weight of another nonionic unsaturated monomer than the monomer (A).

7. A rosin emulsion sizing agent according to claim 5 wherein the dispersant has a weight average molecular weight of 1,000 to 200,000.

8. A rosin emulsion sizing agent according to claim 5 wherein the content of the dispersant is 1 to 30% by weight based on the rosin substance as calculated on dry weight basis.

* * * * *